US008813822B2

(12) United States Patent
Kusaka et al.

(10) Patent No.: US 8,813,822 B2
(45) Date of Patent: Aug. 26, 2014

(54) VACUUM CASTING APPARATUS

(75) Inventors: Yusei Kusaka, Toyota (JP); Shoichi Tsuchiya, Toyota (JP); Makoto Kikuchi, Nagoya (JP); Hiroyuki Ikuta, Nisshin (JP); Shigeru Hatakeyama, Nagoya (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 10 days.

(21) Appl. No.: 13/992,990

(22) PCT Filed: Dec. 9, 2011

(86) PCT No.: PCT/IB2011/002980

§ 371 (c)(1),
(2), (4) Date: Jun. 10, 2013

(87) PCT Pub. No.: WO2012/080802

PCT Pub. Date: Jun. 21, 2012

(65) Prior Publication Data

US 2013/0255903 A1 Oct. 3, 2013

(30) Foreign Application Priority Data

Dec. 13, 2010 (JP) ..... 2010-276904

(51) Int. Cl.
*B22D 17/22* (2006.01)
*B22D 18/06* (2006.01)

(52) U.S. Cl.
CPC ..... *B22D 17/2236* (2013.01); *B22D 18/06* (2013.01)
USPC ..... 164/347

(58) Field of Classification Search
CPC ..... B22D 17/2236; B22D 18/06
USPC ..... 164/347
See application file for complete search history.

(56) References Cited

U.S. PATENT DOCUMENTS 3,575,233 A * 4/1971 Mahle et al. ..... 164/312
5,359,764 A * 11/1994 Sasaki et al. ..... 29/426.6

FOREIGN PATENT DOCUMENTS

| | | | |
|---|---|---|---|
| JP | 54-184307 | U | 12/1979 |
| JP | 2001-071106 | A | 3/2001 |
| JP | 2003-191059 | A | 7/2003 |
| JP | 2004-202543 | A | 7/2004 |
| JP | 2006-068814 | A | 3/2006 |
| JP | 2006-263797 | A | 10/2006 |
| JP | 2006-334649 | A | 12/2006 |
| JP | 2009-166091 | A | 7/2009 |

OTHER PUBLICATIONS

JPO machine translation of JP 2003-191059, Jul. 8, 2003.*

* cited by examiner

*Primary Examiner* — Keith Walker
*Assistant Examiner* — Kevin E Yoon
(74) *Attorney, Agent, or Firm* — Kenyon & Kenyon LLP

(57) ABSTRACT

A vacuum casting apparatus that performs casting through decompression of a cavity includes: an ejector pin for releasing a molding from a mold; a pinhole that is a hole in which the ejector pin is slidably arranged and that has a small diameter portion and a large diameter portion that is more distant from the cavity than the small diameter portion is and is larger in diameter than the small diameter portion; and a hollow portion that is provided under an end portion, on a side where the cavity is present, of the large diameter portion.

8 Claims, 7 Drawing Sheets

VACUUM CASTING APPARATUS

This is a 371 national phase application of PCT/IB2011/002980 filed 9 Dec. 2011, claiming priority to Japanese Patent Application No. 2010-276904 filed 13 Dec. 2010, the contents of which are incorporated herein by reference.

BACKGROUND OF THE INVENTION

1. Field of the Invention

The invention relates to a vacuum casting apparatus that performs casting through decompression of a cavity.

2. Description of Related Art

Vacuum casting apparatuses for casting metal products and resin products (e.g., vacuum casting die-cast apparatuses) are known which are adapted to decompress the cavity in the mold before casting in order to minimize the possibility of gas bubbles being created in the molding. In some of such vacuum casting apparatuses, an ejector pin is provided which is used to release the molding from the mold. Such an ejector pin is slidably arranged in a pinhole formed in the mold.

As a conventional vacuum casting apparatus, Japanese Patent Application Publication No. 2006-068814 describes a vacuum casting apparatus having a pinhole that is formed, for reducing the resistance against sliding of the ejector pin when ejecting the molding, to have a small diameter portion that is located near the cavity of the mold and is almost equal in diameter to the ejector pin and a large diameter portion that is distant from the cavity and is larger in diameter than the ejector pin.

Meanwhile, it is often the case that a release agent is sprayed to the inner face of the cavity before casting, in order for the molding to be easily released from the mold. For vacuum casting apparatuses having an ejector pin, there is a possibility that the release agent enter the gap between the ejector pin and the pinhole during spraying of the release agent.

If the vacuum casting apparatus has the small diameter portion and the large diameter portion, such as those described above, in the pinhole, the release agent that has entered the gap between the ejector pin and the pinhole accumulates in the large diameter portion of the pinhole. FIG. 7 illustrates an example of such a state. Referring to FIG. 7, as a cavity 50 is decompressed, a release agent M accumulating in a large diameter portion 53 of a pinhole 52 in which an ejector pin 51 is arranged is sucked into the cavity 50 due to the flow of air drawn into the cavity 50 (refer to the broken line arrows in FIG. 7). As such, an excessive amount of the release agent M is brought to near the opening of the pinhole 52 in the cavity 50, and the water contained in the release agent M is taken into the molten material, creating gas pores in the molding.

The release agent may be prevented from entering the gap between the ejector pin and the pinhole, if the release agent is sprayed while sending air into the gap so as to be ejected from the gap, as described in Japanese Patent Application Publication No. 2001-071106. In such a case, however, a pump for feeding compressed air, or the like, is required, making the mold structure and casting control complicated.

SUMMARY OF THE INVENTION

The invention provides a vacuum casting apparatus that is capable of preventing a release agent, which has entered a gap between an ejector pin and a pinhole, from being sucked into a cavity during decompression of the cavity.

The first aspect of the invention relates to a vacuum casting apparatus that performs casting through decompression of a cavity, includes: an ejector pin that releases a molding from a mold; a pinhole in which the ejector pin is slidably arranged, wherein the pinhole has a small diameter portion and a large diameter portion that is more distant from the cavity than the small diameter portion is and that is larger in diameter than the small diameter portion; and a hollow portion that is provided under an end portion (cavity side end portion), on a side where the cavity is present, of the large diameter portion.

According to the vacuum casting apparatus described above, for example, the release agent that has entered a gap between the ejector pin and the pinhole during spraying of the release agent is carried toward the cavity by the airflow that occurs during decompression of the cavity. However, owing to the hollow portion provided under the cavity side end portion of the large diameter portion, the release agent, being carried toward the cavity, drops into the hollow portion when reaching the same end portion. Since the hollow portion is not subjected to the airflow toward the cavity, the release agent caught in the hollow portion does not directly contact the airflow toward the cavity, and therefore it is not sucked up by the airflow toward the cavity. Accordingly, the vacuum casting apparatus described above prevents the release agent, which has entered the gap between the ejector pin and the pinhole, from being sucked into the cavity during decompression of the cavity, that is, from being taken into the molten material to be cast.

The diameter of the small diameter portion may be almost equal to the ejector pin.

The hollow portion may be a groove extending vertically downward from the cavity side end portion of the large diameter portion of the pinhole.

A surface treatment for increasing hydrophobicity may be applied to a surface of the cavity side end portion of the large diameter portion. In this case, increased in hydrophobicity, the cavity side end portion of the large diameter portion repels the release agent reaching it, facilitating the release agent to drop into the hollow portion, and thus more effectively preventing the release agent from being sucked into the cavity.

The surface treatment for increasing hydrophobicity may be a surface treatment for forming a carbon-nanotube layer on the surface of the cavity side end portion of the large diameter portion.

Further, the vacuum casting apparatus described above may include an embedded member that is embedded in the mold, and the hollow portion are defined by a, first recesses formed in an outer face of the embedded member. According to this structure, the hollow portion can be easily formed.

Further, the vacuum casting apparatus described above may include a passage that is connected to the hollow portion and extends to an outside. According to this structure, the release agent caught in the hollow portion can be discharged to the outside through the passage.

The passage may be defined by a second recess formed in the outer face of the embedded member.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

First Example Embodiment

Hereinafter, a vacuum casting apparatus of the first example embodiment of the invention will be described in detail with reference to FIGS. 1 to 5.

Figure 1:
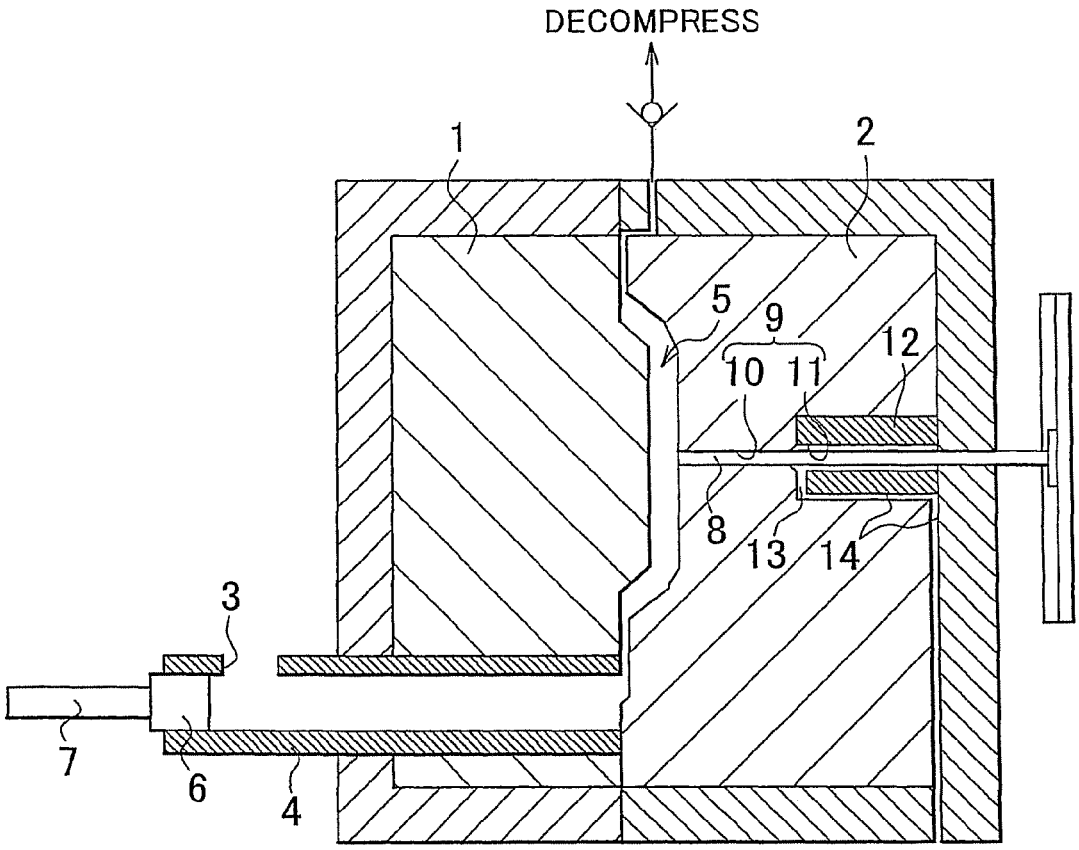
FIG. 1 is a sectional side view showing the structure of a vacuum casting apparatus of the first example embodiment of the invention.

Referring to FIG. 1, a movable mold piece 2 is placed adjacent to a stationary mold piece 1 fixed on the floor such that the stationary mold piece 1 and the movable mold piece 2 are opposed to each other. The movable mold piece 2 may be moved toward or away from the stationary mold piece 1. A tubular sleeve 4 is provided at the stationary mold piece 1. The tubular sleeve 4 includes a molten material inlet 3 through which a molten material is fed. A plunger 7 is provided in the sleeve 4 and slidably arranged. The plunger 7 has, at its one end, a plunger tip 6 used to push the molten material out to a cavity 5 defined by the opposing faces of the respective mold pieces 1 and 2.

A pinhole 9 is formed in the movable mold piece 2, and an ejector pin 8 is slidably arranged in the pinhole 9. The ejector pin 8 is used to push the molding to release it the mold. The pinhole 9 includes a small diameter portion 10 that is located near the cavity 5 and is almost equal in diameter to the ejector pin 8, and a large diameter portion 11 that is located more distant from the cavity 5 than the small diameter portion 10 is and is larger in diameter than the ejector pin 8, that is, larger in diameter than the small diameter portion 10. The large diameter portion 11 of the pinhole 9 is defined by a cylindrical embedded member 12 that is inserted into the movable mold piece 2 from its rear side and then fixed in position. In the first example embodiment, the small diameter portion 10 directly communicates with the cavity 5 and is adjacent to the large diameter portion 11.

Figure 2A:
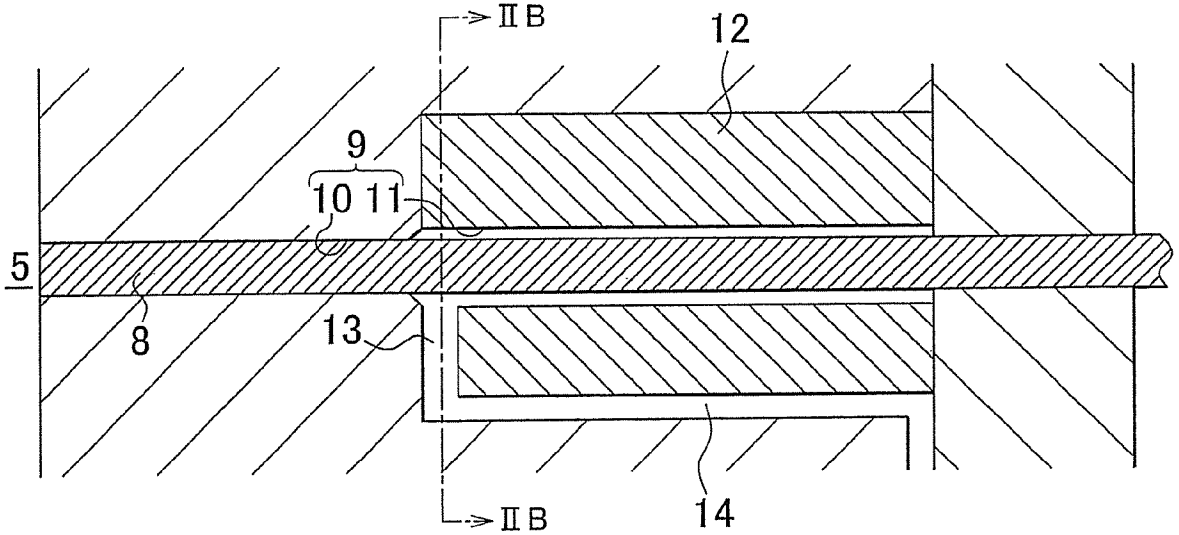
FIG. 2A is a sectional side view showing a pinhole and its peripheral structures in the vacuum casting apparatus of the first example embodiment.
Figure 2B:
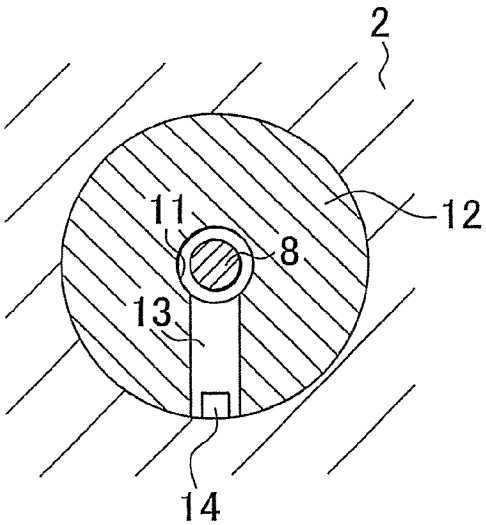
FIG. 2B is a cross-sectional elevation view showing the pinhole and its peripheral structures in the vacuum casting apparatus of the first example embodiment.

Referring to FIGS. 2A and 2B, a groove 13 (an example of "hollow portion") is provided under the cavity 5 side end portion (the end portion near the cavity 5) of the large diameter portion 11 of the pinhole 9, such that it extends vertically downward from the same end portion, and a passage 14 generally rectangular in cross section is connected to the lower end of the groove 13. The passage 14 extends out of the vacuum casting apparatus. It is to be noted that FIG. 2B is a cross-sectional view taken along the line IIB-IIB in FIG. 2A.

Figure 3A:
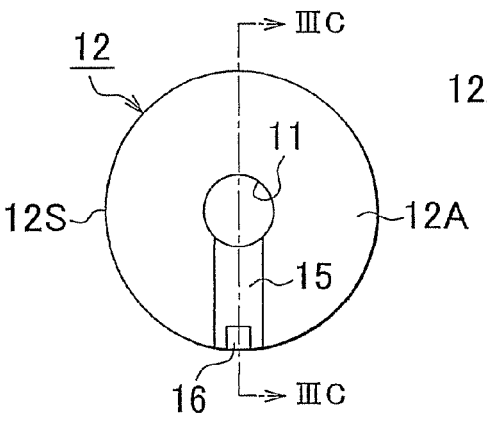
FIG. 3A is an elevation view showing the structure of an embedded member that is provided in the vacuum casting apparatus of the first example embodiment.
Figure 3C:
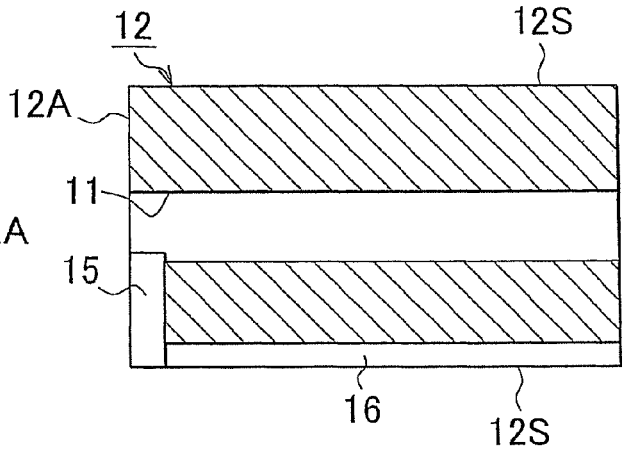
FIG. 3C is a sectional side view showing the structure of the embedded member.
Figure 3B:
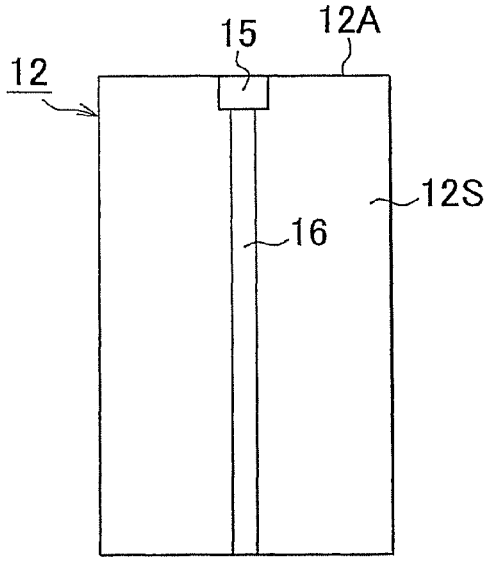
FIG. 3B is a bottom view showing the structure of the embedded member.

Referring to FIGS. 3A and 3B, the groove 13 is fowled by providing a vertically extending recess 15, which is generally rectangular in cross section, at an end face 12A of the cylindrical embedded member 12. The passage 14 is formed by providing a horizontally extending recess 16, which is generally rectangular in cross section, at a peripheral face 12S of the embedded member 12. It is to be noted that FIG. 3C is a sectional view taken along the line IIIC-IIIC in FIG. 3A.

Figure 4:
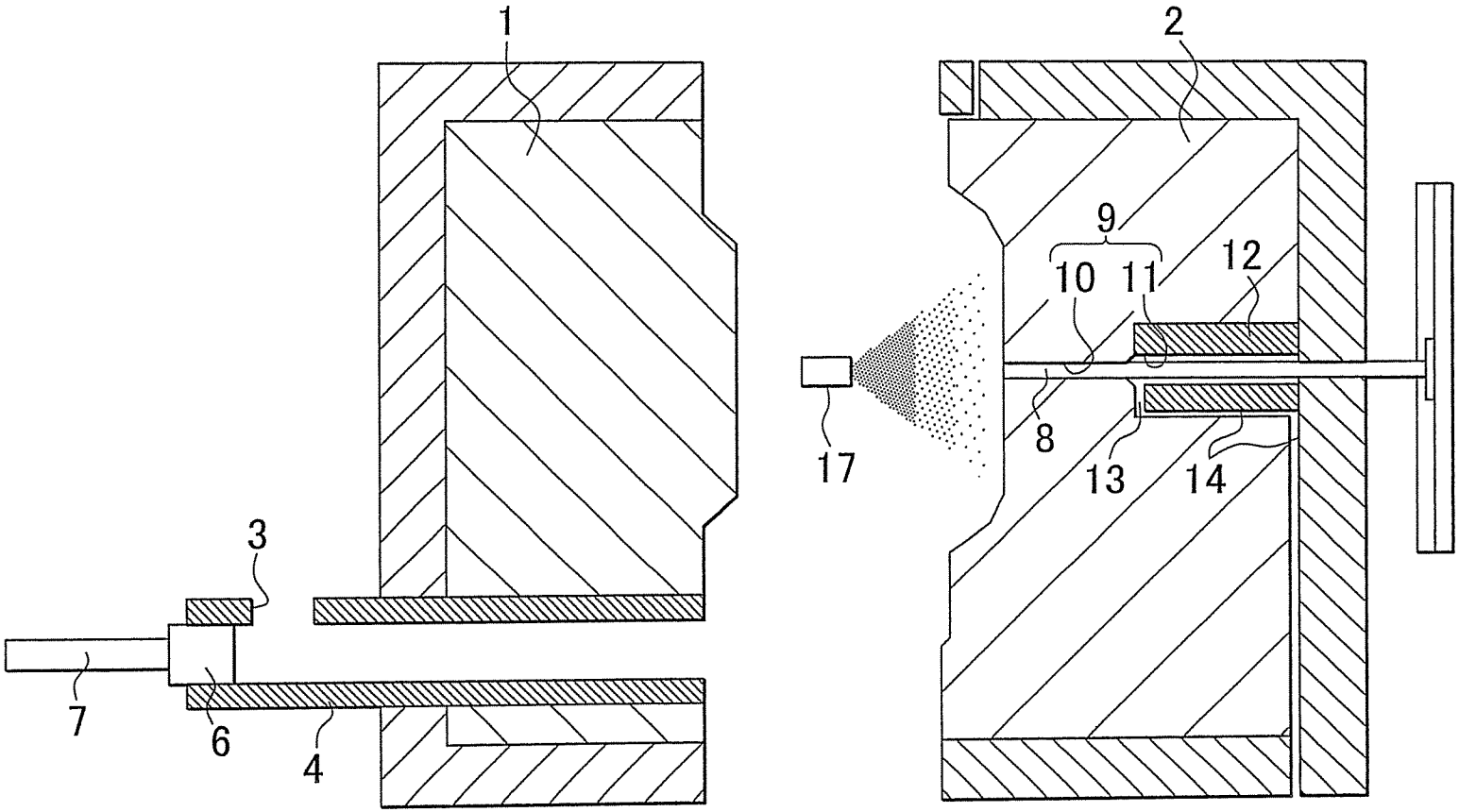
FIG. 4 is a sectional view illustrating how a release agent is sprayed in the vacuum casting apparatus of the first example embodiment.

Next, the effects of the first example embodiment having the structure described above will be described. As a preparation for casting, a release agent is sprayed, using a nozzle 17, to and thus applied on the inner face of the cavity 5, as shown in FIG. 4. Note that when the release agent is thus sprayed, the release agent enters the gap between the ejector pin 8 and the pinhole 9.

Figure 5:
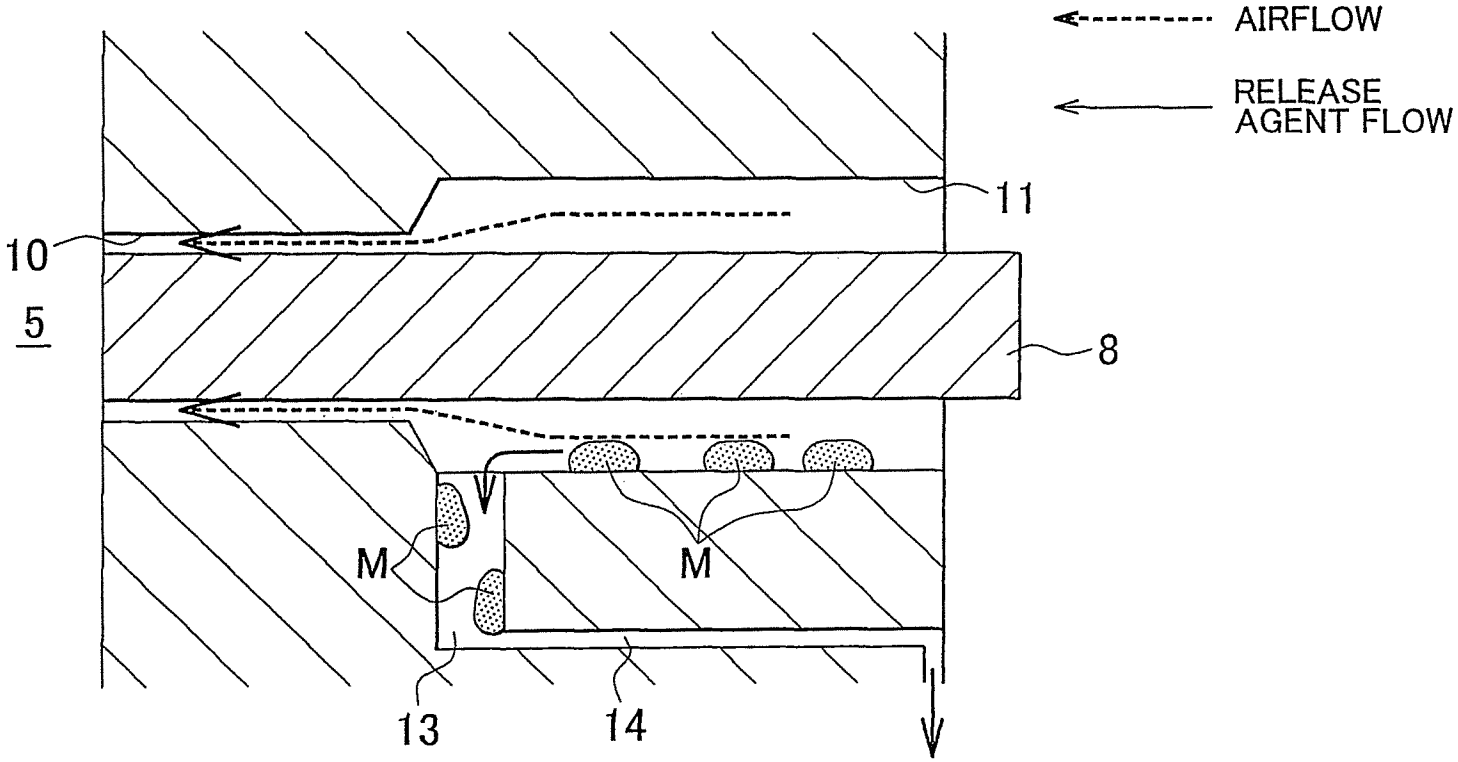
FIG. 5 is a sectional view illustrating the state in the pinhole and its vicinity during decompression of the cavity in the vacuum casting apparatus of the first example embodiment.

Then, the cavity 5 is decompressed for casting. At this time, an airflow toward the cavity 5 occurs in the gap between the ejector pin 8 and the pinhole 9, as shown in FIG. 5. Thus, the release agent that has entered the large diameter portion 11 of the pinhole 9 (will be referred to as "release agent M") is carried toward the cavity 5 by the airflow. It is to be noted that the broken line arrows in FIG. 5 indicate the airflow toward the cavity 5, and the solid line arrow in FIG. 5 indicates the flow of the release agent M.

According to the vacuum casting apparatus of the first exam embodiment, in the state described above, due to the groove 13 provided under the cavity 5 side end portion of the large diameter portion 11 of the pinhole 9, the release agent M drops into the groove 13 by gravity when reaching the same end portion. Since the groove 13 is not subjected to the airflow toward the cavity 5, the release agent M caught in the groove 13 does not directly contact the airflow toward to the cavity 5. Accordingly, thus, once caught in the groove 13, the release agent M will not be sucked up by the airflow toward the cavity 5, but it is moved by gravity through the passage 14 and then discharged to the outside of the vacuum casting apparatus.

Structured as described above, the vacuum casting apparatus of the first example embodiment provides the following effects.

(1) In the first example embodiment, the groove 13 (an example of "hollow portion") is provided under the cavity 5 side end portion of the large diameter portion 11 of the pinhole 9, such that it extends vertically downward from the same end portion. Therefore, the release agent M, which has entered the gap between the ejector pin 8 and the pinhole 9, can be prevented from being sucked into the cavity 5 during decompression of the cavity 5, that is, from being taken into the molten material to be cast.

(2) In the first example embodiment, the movable mold piece 2 having the pinhole 9 has an embedding structure in which the groove 13 (an example of "hollow portion") and the passage 14 extending to the outside from the groove 13 are defined, respectively, by the vertically extending recess 15 and the horizontally extending recess 16 formed in the outer faces of the embedded member 12. Accordingly, the groove 13 and the passage 14 can be formed easily.

Second Example Embodiment

Next, a vacuum casting apparatus of the second example embodiment of the invention will be described in detail with reference to FIGS. 6A and 6B, It is to be noted that the structural elements in the second example embodiment that are identical to those in the first example embodiment described above will be denoted using the same reference numerals, and their descriptions will be omitted.

In the first example embodiment, as described above, the groove 13 is provided under the cavity 5 side end portion of the large diameter portion 11 of the pinhole 9, so that the release agent M, which has entered the gap between the ejector pin 8 and the pinhole 9, is caught in the groove 13 and thereby prevented from being sucked into the cavity 5. In this case, although the majority of the release agent M collects, by gravity, in the lower side of the large diameter portion 11, a small part of the release agent M may adhere on the side faces and top face of the large diameter portion 11, and it may be sucked into the cavity 5, rather than dropping into the groove 13.

Figure 6B:
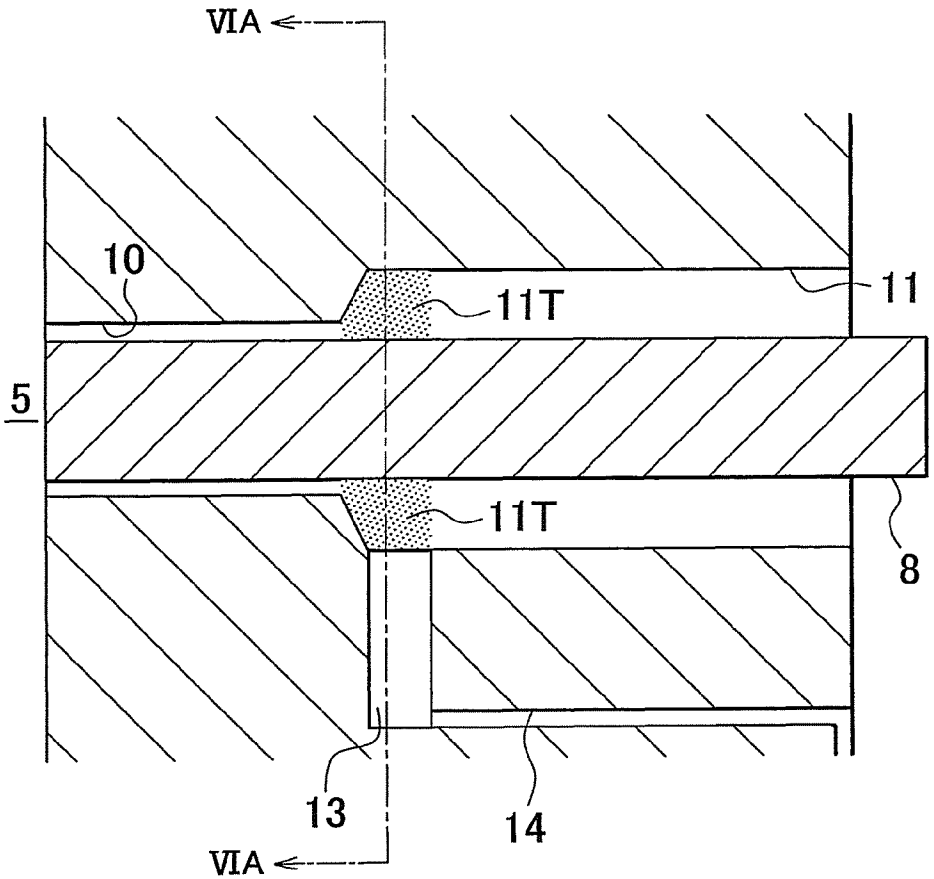
FIG. 6B is a sectional side view showing the pinhole and its peripheral structures in the vacuum casting apparatus of the second example embodiment.
Figure 6A:
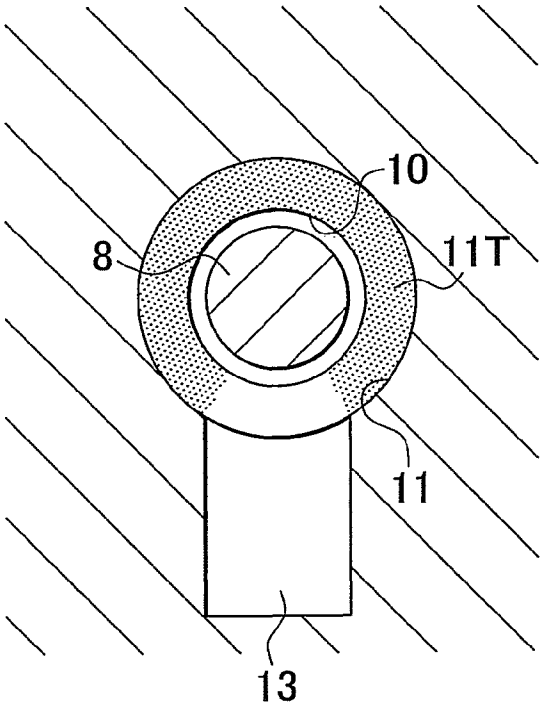
FIG. 6A is a cross-sectional elevation view showing a pinhole and its peripheral structures in a vacuum casting apparatus of the second example embodiment of the invention.
Figure 7:
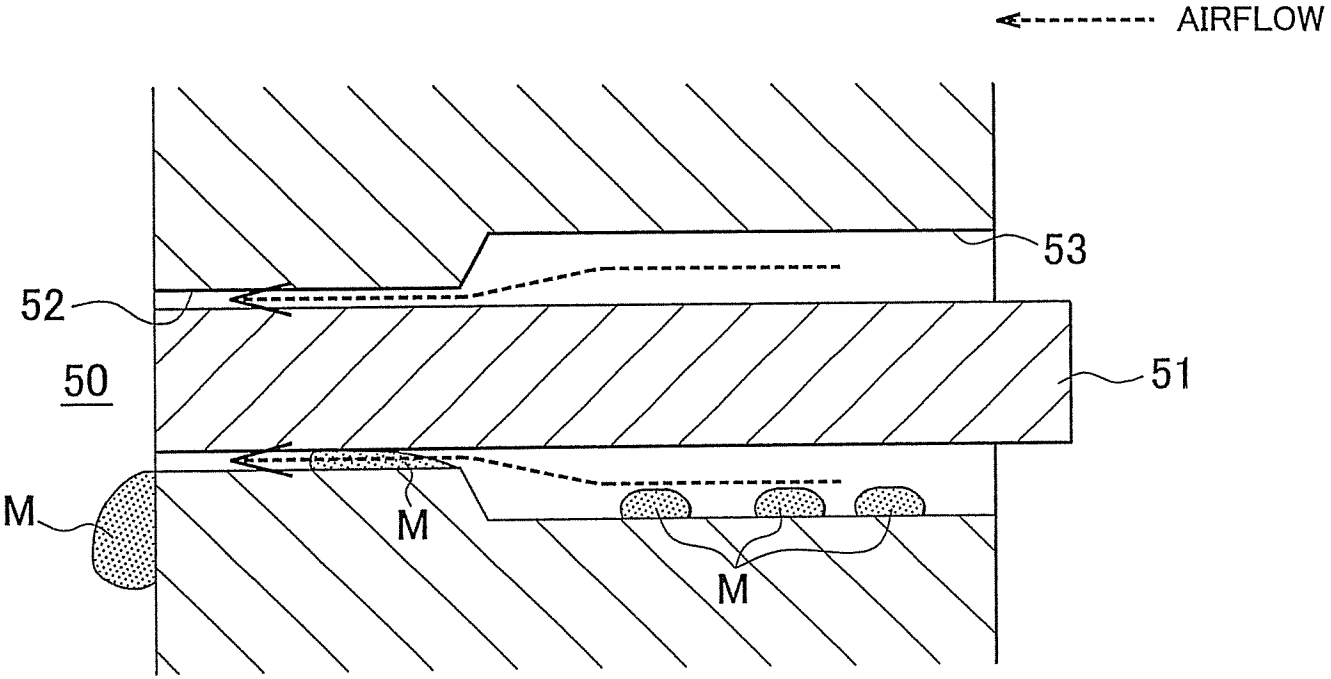
FIG. 7 is a sectional view illustrating the state in a pinhole and its vicinity during decompression of a cavity in a related-art vacuum casting apparatus.

To counter this, in the vacuum casting apparatus of the second example embodiment, a surface treatment for increasing hydrophobicity (hydrophobicity surface treatment) is applied to a surface 11T, shown in FIGS. 6A and 6B, of the cavity 5 side end portion of the large diameter portion 11 of the pinhole 9. More specifically, in this example embodiment, a hydrophobicity surface treatment for forming a carbon-nanotube layer on the surface 11T is performed. It is to be noted that FIG. 6A is a cross-sectional view taken along the line VIA-VIA in FIG. 6B.

In the second example embodiment, due to the surface 11T treated by the hydrophobicity surface treatment described above, the adhesion of the release agent M to the surface 11T is relatively low, facilitating the release agent M, which reaches to the surface 11T, to drop downward by gravity. According to the second example embodiment, as such, the release agent M adhering on the side faces and top face of the large diameter portion 11 can be more reliably made to drop into the groove 13.

The second example embodiment provides the following effect, in addition to the effects (1) and (2) described above.

(3) In the second example embodiment, the surface treatment for increasing hydrophobicity is applied to the surface 11T of the cavity 5 side end portion of the large diameter portion 11 of the pinhole 9, and therefore the release agent M can be more effectively prevented from being sucked into the cavity 5.

Meanwhile, the foregoing example embodiments may be modified as follows. While the release agent M caught in the groove 13 is discharged to the outside by gravity in the foregoing example embodiments, the release agent M may be forcibly discharged by pumping air out of the passage 14. In this case, the air may be pumped out of the passage 14 using a decompressor for decompressing the cavity 5.

While the surface treatment for increasing the hydrophobicity is performed by forming the carbon-nanotube layer in the second example embodiment, the hydrophobicity of the surface 11T may be increased by various other surface treatments. That is, as long as the hydrophobicity of the surface 11T is increased through a given surface treatment, the release agent M can be more effectively prevented from being sucked into the cavity 5.

While the surface treatment for increasing hydrophobicity is applied only to the surface 11T of the cavity 5 side end portion of the large diameter portion 11 of the pinhole 9 in the second example embodiment, it may be applied to the entire surface of the large diameter portion 11.

While the movable mold piece 2, in which the pinhole 9 is formed, has an embedding structure in which the groove 13 (an example of "hollow portion") and the passage 14 extending to the outside from the groove 13 are defined, respectively, by the vertically extending recess 15 and the horizontally extending recess 16 formed in the outer faces of the embedded member 12 in the foregoing example embodiments, the movable mold piece 2 does not necessarily have an embedding structure, as long as the groove 13 and the passage 14 can be formed.

While the groove 13 is formed as "hollow portion" for catching the release agent M in the foregoing example embodiments, the hollow portion may be provided in various other fowls and sizes, as long as it can catch the release agent M.

Although the passage 14 is provided to discharge the release agent M that has dropped into the hollow portion (i.e., the groove 13) to the outside of the vacuum casting apparatus in the foregoing example embodiments, if the volume of the hollow portion is large enough to store therein the entirety of the release agent M caught by the hollow portion, the caught release agent M can be accumulated in the hollow portion during casting. In such a case, therefore, the passage 14 may be omitted, and the release agent M accumulated in the hollow portion may be removed after casting, that is, it does not need to be discharged to the outside via the passage 14.

The invention claimed is:

1. A vacuum casting apparatus that performs casting through decompression of a cavity, comprising:

an ejector pin that releases a molding from a mold;

a pinhole in which the ejector pin is slidably arranged, wherein the pinhole has a small diameter portion and a large diameter portion that is more distant from the cavity than the small diameter portion is and that is larger in diameter than the small diameter portion; and a hollow portion that is provided under an end portion, on a side where the cavity is present, of the large diameter portion such that a release agent, being carried toward the cavity, is allowed to drop into the hollow portion.

2. The vacuum casting apparatus according to claim 1, wherein the diameter of the small diameter portion is almost equal to the ejector pin.

3. The vacuum casting apparatus according to claim 1, wherein the hollow portion is a groove extending vertically downward from the end portion of the large diameter portion.

4. The vacuum casting apparatus according to claim 1, wherein a surface of the end portion of the large diameter portion has an increased hydrophobicity by a surface treatment for increasing hydrophobicity.

5. The vacuum casting apparatus according to claim 4, wherein the surface treatment forms a carbon-nanotube layer on the surface of the end portion of the large diameter portion.

6. The vacuum casting apparatus according to claim 1, further comprising an embedded member that is embedded in the mold, wherein the hollow portion is defined by a first recess formed in an outer face of the embedded member.

7. The vacuum casting apparatus according to claim 1, further comprising a passage that is connected to the hollow portion and extends to an outside.

8. The vacuum casting apparatus according to claim 6, further comprising a passage that is connected to the hollow portion and extends to an outside, wherein the passage is defined by a second recess formed in the outer face of the embedded member.

* * * * *